United States Patent [19]

Aarestad

[11] Patent Number: 4,880,352

[45] Date of Patent: Nov. 14, 1989

[54] CENTRIFUGAL LIQUID PUMP

[75] Inventor: Jerome K. Aarestad, Rockford, Ill.

[73] Assignee: Sundstrand Corporation, Rockford, Ill.

[21] Appl. No.: 124,071

[22] Filed: Nov. 23, 1987

[51] Int. Cl.[4] ..... F04D 29/44

[52] U.S. Cl. ..... 415/182.1; 415/208.1; 415/219.1

[58] Field of Search ..... 415/182, 184, 185, 208, 415/213 A, 74, 219 C

[56] References Cited

U.S. PATENT DOCUMENTS

| | | | |
|---|---|---|---|
| 2,542,902 | 2/1951 | Chubbuck | 415/208 |
| 3,311,292 | 3/1967 | Connor | 415/208 |
| 3,339,490 | 9/1967 | Glass | 415/182 |
| 3,421,446 | 1/1969 | Strcheletzky et al. | 415/208 X |
| 3,735,782 | 5/1973 | Strcheletzky | 415/182 X |
| 3,859,008 | 1/1975 | Wieser | 415/208 X |

FOREIGN PATENT DOCUMENTS

| | | | |
|---|---|---|---|
| 3011888 | 10/1981 | Fed. Rep. of Germany | 415/182 |
| 1267050 | 10/1986 | U.S.S.R. | 415/213 A |
| 1237961 | 7/1971 | United Kingdom | 415/182 |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

A centrifugal liquid pump including a housing section having an intake cavity and defining a rotational axis of the pump. An impeller section is in communication with and extends coaxially of the intake cavity of the housing section. An impeller is mounted in the impeller section rotatable about the pump axis. A ramp is formed in the intake cavity of the housing section about the pump axis. The ramp includes an axial slope component such that liquid rotating in the intake cavity will be given an axial component of motion toward the impeller section and a radial slope component such that liquid rotating in the intake cavity will be given a radially inward component of motion toward the pump axis.

22 Claims, 1 Drawing Sheet

CENTRIFUGAL LIQUID PUMP

FIELD OF THE INVENTION

This invention generally relates to fluid pumps and, particularly, to a centrifugal liquid pump having an intake cavity and an impeller cavity generally perpendicular to the intake cavity.

BACKGROUND OF THE INVENTION

There are known centrifugal liquid pumps which have a housing section defining a rotational axis of the pump, with an intake cavity defining an annular area generally perpendicular to the rotational axis. An intake port leads to the cavity generally radially of the axis. An impeller section is located in communication coaxially with the intake cavity of the housing section for pumping the liquid out of the cavity. The impeller section conventionally includes a rotatable impeller.

Such pumps often are used in environments wherein the pumped liquid contains contaminants, such as contaminant particles. One such environment is in the application of fuel pumps where the fuel may contain contaminating particles. These pumps normally operate at high speeds and the impeller provides a suction head that draws the fuel carrying the contaminant particles through the inlet port, around the intake cavity and into the impeller section of the pump.

However, problems occur with the contaminant particles when the pump is idling at a low R.P.M. or at low flow conditions. In this state of operation, there is an insufficient suction head to draw the fuel with its entrained contaminants from the intake cavity into the impeller section. This state of operation can have extended duration in such applications as aircraft fuel pumps. The problem is that the contaminant particles build up in a wall of sludge about the outer bounds of the intake cavity. Therefore, upon an increase of speed of the pump, this concentrated mass of contaminants will immediately pass into the fuel system rather than be evenly dispersed in the fuel as may be expected. Furthermore, a major problem is caused by the continuous circular movement of the concentrated contaminant particles about the inlet cavity as the particles impinge upon the cavity walls. This causes considerable wear and may even deteriorate the walls to an extent which would cause pump inlet leakage.

Some prior art solutions to the above problems, particularly the potential wear-through problem, involve armor plating the walls of the inlet cavity to withstand the erosion thereof created by the continuous movement of the contaminant particles. Such solutions not only are expensive but face the additional problem of providing fuel-compatible armor materials.

This invention is directed to solving the above problems by a novel configuration of the intake cavity such that the contaminant particles are moved into the fuel system regardless of the speed or the flow rate of the fluid.

SUMMARY OF THE INVENTION

An object, therefore, of the invention is to provide a new and improved centrifugal liquid pump of the character described to solve the described problems.

In the exemplary embodiment of the invention, the pump generally includes a housing section having an intake cavity and defining a rotational axis of the pump. An impeller section is in communication coaxially with the intake cavity of the housing section, i.e. extending generally perpendicular thereto. Impeller means are provided in the impeller section rotatable about the pump axis. Ramp means are provided in the housing section about the pump axis, the ramp means including an axial slope component such that liquid rotating in the intake cavity will be given an axial component of motion toward the impeller section and a radial sloped component such that liquid rotating in the intake cavity will be given a radially inward component of motion toward the pump axis. The resulting radially inward motion of the liquid prevents any contaminants from accumulating or lodging in the intake cavity of the housing section.

As disclosed in the preferred embodiment, the intake cavity is defined by an annulus about the pump axis formed by continuous concave wall means of the housing section. Part of the concave wall means defines the axial and radial slope components of the ramp means. An intake port is provided in the housing section to the intake cavity. Preferably, the concave wall means of the annulus curve toward and terminate at a common terminus of the axial and radial sloped components of the ramp means, the terminus being remote from the intake port. As disclosed, the terminus is located generally diametrically opposite the intake port.

The impeller section is shown as being generally cylindrical, and the concave wall means of the intake cavity are located radially outwardly of the internal diameter of the cylindrical impeller section about a substantial angular extent of the annulus. However, the concave wall means of the annulus curve radially inwardly of the internal diameter of the cylindrical impeller section to define the radial slope component of the ramp means to absolutely insure that fuel contaminants are completely directed inwardly of the bounds of the impeller means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
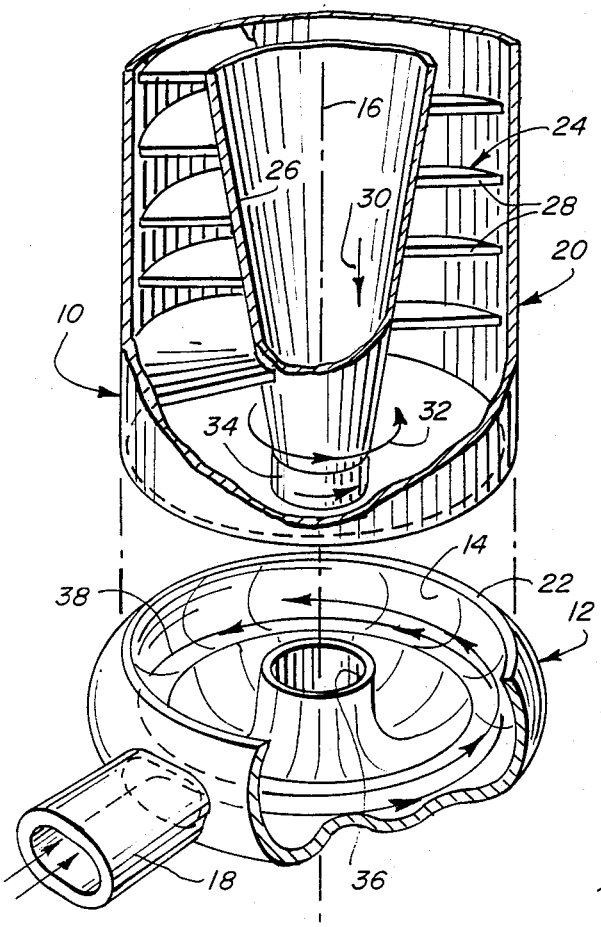
FIG. 1 Prior Art
FIG. 1 is a fragmented, exploded view of the housing section and impeller section of a centrifugal liquid pump of the prior art.

Referring to the drawings in greater detail, FIG. 1 shows the general construction of a centrifugal liquid pump, generally designated 10, constructed according to conventional practice of the prior art. Specifically, a housing section, generally designated 12, includes an intake cavity 14 and defines a rotational axis 16 of the pump. An intake port 18 extends through housing 12 in communication with cavity 14 in a generally radial direction. A cylindrical impeller section, generally designated 20, is secured to a circular ledge 22 about the top of housing section 12, as by welding or the like. Impeller means, generally designated 24, are disposed in impeller section 20 rotatable about pump axis 16. The impeller means may comprise a variety of configurations, but the impeller means shown in the drawings include a central conical portion 26 surrounded by impeller vanes 28. In essence, the impeller vanes form propellers for moving the liquid out of intake cavity 14, i.e. upwardly in the direction of arrow 30 as the impeller means rotates in the direction of arrow 32. Impeller vanes 28 may be segmented or may comprise a continuous spiral impeller blade. Conical portion 26 of the impeller means includes a lower distal cylindrical portion 34, of reduced diameter, for positioning within a central opening 36 in housing section 12. Appropriate drive means, such as a drive shaft from a motor, conventionally would extend upwardly through opening 36 for rotating impeller means 24 in the direction of arrow 32.

It can be seen in FIG. 1 that intake cavity 14 of the prior art is defined by an annulus about pump axis 16 formed by continuous concave wall means. This creates a centrifugal flow path, as indicated by arrows 38, whereby the liquid, such as a fuel, enters the intake cavity and starts circling around for eventual withdrawal by impeller means 24. As stated above, normal contaminants in a liquid such as fuel will pass with the liquid and be impelled by the pump into the fuel system under high speed rotary motion of vaned impeller means 24, because the impeller means creates a suction head that draws the fuel carrying contaminant particles through intake port 18, around intake cavity 14 and upwardly through the pump. However, during low R.P.M. or at low flow conditions, an insufficient suction head is developed to draw the entrained contaminants with the liquid upwardly into impeller section 20. Consequently, the contaminant particles rapidly build up a wall of sludge or, worse yet, continuous circular movement of the particles causes severe wear to the concave wall means about the annulus of intake cavity 14.

Figure 2:
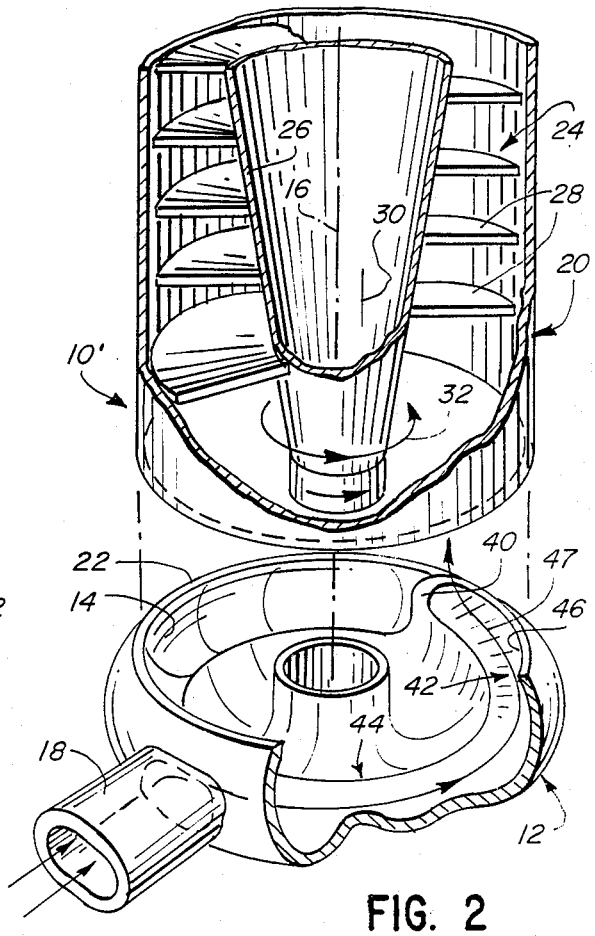
FIG. 2 is a fragmented, exploded view of the housing section and impeller section of a centrifugal liquid pump of the invention.

FIG. 2 shows a centrifugal liquid pump, generally designated 10', similar to pump 10 of FIG. 1, but incorporating the concepts of the invention. Consequently, like reference numbers have been applied to FIG. 2 corresponding to like components described in relation to pump 10 of FIG. 1.

Generally, the invention contemplates forming the concave wall means of intake cavity 14 of housing section 12 with ramp means to impart both an axial component of motion on the liquid toward impeller section 20 and impeller means 24, as well as a radial component of motion on the liquid inwardly toward pump axis 16.

More particularly, FIG. 2 shows the wall means of intake cavity 14 as sloping upwardly, i.e. axially toward impeller section 20, toward a terminus 40 which generally is continuous with circular ledge 22 about the top of housing 12. In other words, a ramp means, generally designated 42, begins approximately at a point indicated by arrow 44 as a smooth continuation of the intake cavity annulus formed by the concave wall means of intake cavity 14. This axial slope component of the ramp means is effective such that liquid rotating in intake cavity 14 will be given an axial component of motion toward impeller section 20 and impeller means 24. Preferably, terminus 40 is approximately diametrically opposite intake port 18.

In addition, the extreme radially outer areas of the concave wall means defining intake cavity 14 progressively slope radially inwardly, as at 46, to impart a radial component of motion to the liquid inwardly toward pump axis 16. In other words, the ramp means also is provided with a radial slope component such that liquid rotating in intake cavity 14 will be given a radially inward component of motion toward the pump axis. The radially inwardly sloping wall means also terminates at terminus 40. This radially inward direction of the rotating liquid, in combination with terminus 40, prevents fuel contaminant particles from becoming lodged in the outer peripheral bounds of intake cavity 14. The flow of liquid upwardly and inwardly along the ramp means is shown by arrow 47.

Figure 3:
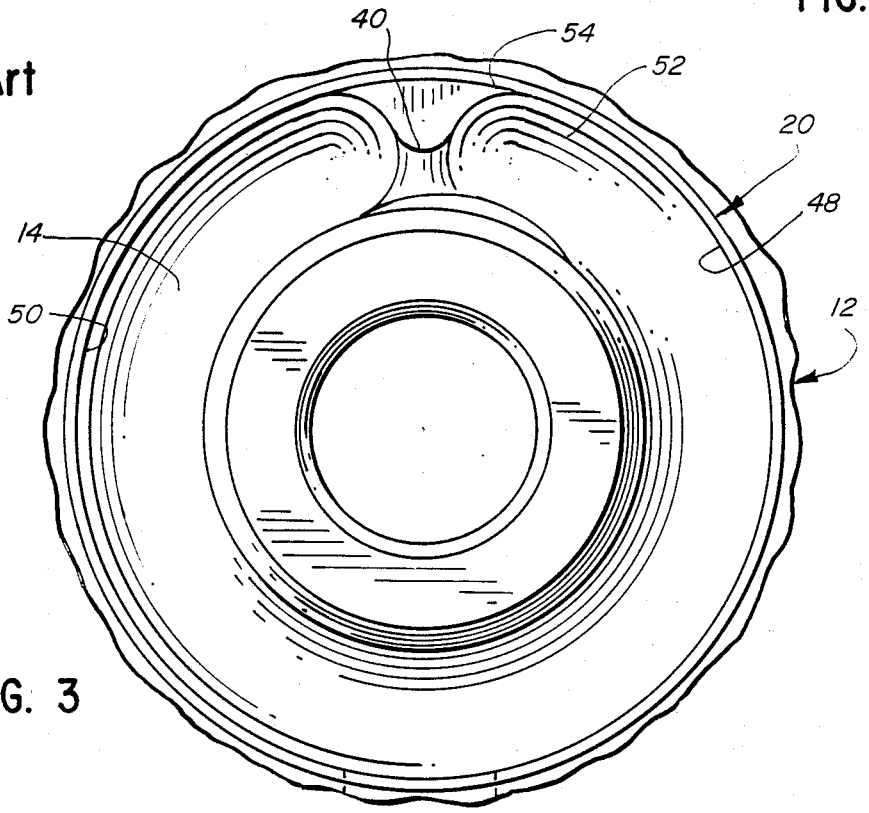
FIG. 3 is a top plan view looking down into the impeller section, with the impeller means removed to facilitate an interior view looking downward into the intake cavity of the housing section.

Referring to FIG. 3, it can be seen that impeller section 20 is cylindrical and defines an interior cylinder 48 within which impeller means 24 (FIG. 2) is rotatably mounted. Terminus 40 of the above-described ramp means is clearly visible in this view. The radially outer area of the terminus preferably is coplanar with with the top ledge 22 (see FIG. 2) of housing section 12. Intake cavity 14 to one side of intake port 18 and terminus 40 (i.e. the lefthand side as viewed in the drawing) extends beneath and radially outwardly of the cylindrical bounds or diameter of cylinder 48, as illustrated by arrow 50. This view also shows how the concave wall means of intake cavity 14, on the opposite or right-hand side of intake port 18 and annulus 40 slopes radially inwardly, as at 52, to impart the radially inward component of motion to the liquid toward the pump axis. In fact, it can be seen at 54 that the wall means curves radially inwardly beyond the internal diameter of cylinder 48 to insure that all contaminants in the liquid pass with the liquid inwardly and upwardly into the impeller section. Furthermore, by placing annulus 40 diametrically opposite intake port 18, with the annulus formed by the concave wall means of intake cavity 14, a substantially uniform pressure distribution is provided in the intake cavity, with the circular flow path of the liquid being substantially 360 degrees leading upwardly and inwardly toward annulus 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A centrifugal liquid pump, comprising:

a housing section including an intake cavity defined by an annulus about a rotational axis of the pump;

an impeller section in communication with and coaxially of the intake cavity of the housing section;

impeller means in the impeller section rotatable about said axis; and ramp means defined by wall means in the annulus of the housing section about said axis including an axial slope component such that liquid rotating in the intake cavity will be given an axial component of motion toward the impeller section and a radial slope component such that liquid rotating in the intake cavity will be given a radially inward component of motion toward the pump axis in response to centrifugal movement about the annulus.

2. The centrifugal liquid pump of claim 1 wherein the housing section includes an intake port, and at least a major portion of the radial slope component of the ramp means is located remote from the inlet port.

3. The centrifugal liquid pump of claim 1 wherein the housing section includes an intake port, and at least a major portion of the axial slope component of the ramp means is located remote from the inlet port.

4. The centrifugal liquid pump of claim 3 wherein the housing section includes an intake port, and at least a major portion of the radial slope component of the ramp means is located remote from the inlet port.

5. The centrifugal liquid pump of claim 1 wherein said axial and radial slope components terminate in a common terminus.

6. A centrifugal liquid pump, comprising:

a housing section including an intake port in communication with an intake cavity defining a rotational axis of the pump, the intake cavity being defined by an annulus about said axis formed by substantially continuous concave wall means of the housing section about the pump axis;

an impeller section in communication coaxially with the intake cavity of the housing section;

impeller means in the impeller section rotatable about said axis; and ramp means defined by said concave wall means of the intake cavity of the housing section about said axis including an axial slope component such that liquid rotating in the intake cavity will be given an axial component of motion toward the impeller section and a radial slope component such that liquid rotating in the intake cavity will be given a radially inward component of motion toward the pump axis, at least a major portion of the radial slope component of the ramp means being located remote from the inlet port.

7. The centrifugal liquid pump of claim 6 wherein at least a major portion of the axial slope component of the ramp means is located remote from the inlet port.

8. The centrifugal liquid pump of claim 7 wherein said axial and radial slope components of the ramp means terminate in a common terminus.

9. The centrifugal liquid pump of claim 8 wherein said common terminus is located generally diametrically opposite the intake port.

10. The centrifugal liquid pump of claim 6 wherein said impeller section is generally cylindrical and said concave wall means are located radially outwardly of the internal diameter of the cylindrical impeller section about a substantial angular extent of the annulus.

11. The centrifugal liquid pump of claim 10 wherein said concave wall means of the annulus curve radially inwardly of the internal diameter of the cylindrical impeller section to define said radial slope component of the ramp means.

12. The centrifugal liquid pump of claim 10 wherein said concave wall means of the annulus curve axially to one end of the cylindrical impeller section to define said axial slope component of the ramp means.

13. The centrifugal liquid pump of claim 12 wherein said concave wall means of the annulus curve radially inwardly of the internal diameter of the cylindrical impeller section to define said radial slope component of the ramp means.

14. A centrifugal liquid pump, comprising:

a housing section including an intake cavity defined by an annulus about a rotational axis of the pump;

an impeller section in communication with and coaxially of the intake cavity of the housing section;

impeller means in the impeller section rotatable about said axis; and ramp means defined by wall means in the annulus of the housing section about said axis and defining a radial slope component such that liquid rotating in the intake cavity will be given a radially inward component of motion toward the pump axis in response to centrifugal movement about the annulus.

15. A centrifugal liquid pump, comprising:

a housing section including an intake cavity, and intake port and defining a rotational axis of the pump;

an impeller section in communication with and coaxially of the intake cavity of the housing section;

impeller means in the impeller section rotatable about said axis; and ramp means in the intake cavity of the housing section about said axis including an axial slope component such that liquid rotating in the intake cavity will be given an axial component of motion toward the impeller section and a radial slope component such that liquid rotating in the intake cavity will be given a radially inward component of motion toward the pump axis, at least a major portion of both the axial slope component and the radial slope component of the ramp means being located remote from the inlet port, and the axial and radial slope components of the ramp means terminating in a common terminus at a local generally diametrically opposite the intake port.

16. A centrifugal liquid pump, comprising:

a housing section including an intake cavity and defining a rotational axis of the pump, the intake cavity being defined by an annulus about said axis formed by substantially continuous concave wall means of the housing section;

an impeller section in communication with and coaxially of the intake cavity of the housing section;

impeller means in the impeller section rotatable about said axis; and ramp means in the intake cavity of the housing section about said axis including an axial slope component such that liquid rotating in the intake cavity will be given an axial component of motion toward the impeller section and a radial slope component such that liquid retaining in the intake cavity will be given a radially inward component of motion toward the pump axis, and wherein part of said concave wall means defines the axial and radial slope components of the ramp means.

17. The centrifugal liquid pump of claim 16 wherein said impeller section is generally cylindrical and said concave wall means are located radially outwardly of the internal diameter of the cylindrical impeller section about a substantial angular extent of the annulus.

18. The centrifugal liquid pump of claim 17 wherein said concave wall means of the annulus curve radially inwardly of the internal diameter of the cylindrical impeller section to define said radial slope component of the ramp means.

19. The centrifugal liquid pump of claim 17 wherein said concave wall means of the annulus curve axially to one end of the cylindrical impeller section to define said axial slope component of the ramp means.

20. The centrifugal liquid pump of claim 19 wherein said concave wall means of the annulus curve radially inwardly of the internal diameter of the cylindrical impeller section to define said radial slope component of the ramp means.

21. The centrifugal liquid pump of claim 20 wherein said concave wall means of the annulus curve toward and terminate at a common terminus of said axial and radial slope components of the ramp means.

22. A centrifugal liquid pump, comprising:

a housing section including an intake cavity, an intake port and defining a rotational axis of the pump;

an impeller section in communication with and coaxially of the intake cavity of the housing section;

impeller means in the impeller section rotatable about said axis; and ramp means in the intake cavity of the housing section about said axis and defining a radial slope component such that liquid rotating in the intake cavity will be given a radially inward component of motion toward the pump axis, said radial component of the ramp means terminating at a terminus located generally diametrically opposite said intake port.

* * * * *